US010801681B1

(12) United States Patent
Chaimberg et al.

(10) Patent No.: US 10,801,681 B1
(45) Date of Patent: Oct. 13, 2020

(54) RECESSED LIGHT FIXTURE ASSEMBLY WITH INTERCHANGEABLE TRIM COLLAR

(71) Applicant: GLOBE ELECTRIC COMPANY INC., Montreal (CA)

(72) Inventors: Adam Chaimberg, Hampstead (CA); Jay Allard, Laval (CA)

(73) Assignee: GLOBE ELECTRIC COMPANY INC., Montreal, QC (CA)

( * ) Notice: Subject to any disclaimer, the term of this patent is extended or adjusted under 35 U.S.C. 154(b) by 0 days.

(21) Appl. No.: 16/873,282

(22) Filed: Mar. 12, 2020

(51) Int. Cl.

| | |
|---|---|
| ***F21S 8/02*** | (2006.01) |
| ***F21V 21/04*** | (2006.01) |
| ***F21V 29/70*** | (2015.01) |
| ***F21V 21/03*** | (2006.01) |
| *F21Y 115/10* | (2016.01) |

(52) U.S. Cl.
CPC ..... *F21S 8/026* (2013.01); *F21V 21/03* (2013.01); *F21V 21/044* (2013.01); *F21V 29/70* (2015.01); *F21S 8/02* (2013.01); *F21Y 2115/10* (2016.08)

(58) Field of Classification Search
CPC ..... F21S 8/02; F21S 8/026
See application file for complete search history.

(56) References Cited

U.S. PATENT DOCUMENTS 6,474,846 B1 * 11/2002 Kelmelis ..... F21V 17/164 248/231.91
6,957,896 B2 * 10/2005 Burgess ..... F21V 21/04 362/147
2007/0068099 A1 * 3/2007 Kovacs ..... F21S 8/026 52/232
2007/0109796 A1 * 5/2007 Johnson ..... F21S 8/02 362/373
2010/0039829 A1 * 2/2010 Tsai ..... F21V 29/67 362/373
2015/0085499 A1 * 3/2015 Mandy ..... F21V 21/046 362/365
2016/0209018 A1 * 7/2016 Johnson ..... F21V 29/777
2017/0009964 A1 * 1/2017 Chancey ..... F21V 21/04
(Continued)

*Primary Examiner* — Zheng Song
(74) *Attorney, Agent, or Firm* — Guy J. Houle; Houle Patent Agency Inc.

(57) ABSTRACT

A recessed light fixture assembly for securement in a hole formed in a sheet material and wherein the assembly is comprised of a light source support module having an electrical connector for securing a power source thereto for energising the light source, Two or more open-ended light constraining tubular members are each adapted for immovable securement to the light source support module for interconnecting a selected one of the two or more open-ended light constraining tubular members to the light source support module. A first one of the two or more open-ended light constraining tubular members has a trim collar extending in a transverse plane about an outer end thereof. A further of the open-ended light constraining tubular members has a plaster collar extending in a transverse plane spaced a predetermined distance about an outer end thereof. The light source support module has a retention mechanism to retain the recessed light fixture with the selected one of the first and further open-ended light constraining tubular members connected thereto in the hole with its collar held firmly against an outer surface of the sheet material about the hole.

17 Claims, 3 Drawing Sheets

(56) References Cited

U.S. PATENT DOCUMENTS

| | | | | |
|---|---|---|---|---|
| 2017/0045214 | A1* | 2/2017 | Johnson | F21V 21/26 |
| 2017/0059102 | A1* | 3/2017 | Grant | F21V 21/047 |
| 2017/0198870 | A1* | 7/2017 | Wu | F21V 21/108 |
| 2017/0314750 | A1* | 11/2017 | Feldman | F21S 8/026 |
| 2018/0242427 | A1* | 8/2018 | Johnson | H05B 45/20 |
| 2019/0145610 | A1* | 5/2019 | Wronski | F21S 8/026 362/365 |
| 2019/0383451 | A1* | 12/2019 | Robinson | G02B 6/0088 |

* cited by examiner

RECESSED LIGHT FIXTURE ASSEMBLY WITH INTERCHANGEABLE TRIM COLLAR

FIELD OF THE INVENTION

The present invention relates to recessed light fixtures and more specifically to recessed light fixtures for mounting in holes formed in a sheeting material of a ceiling or wall and wherein the recessed light fixture is permanently or removably secured in the hole and further wherein the recessed light fixture has the option of being provided with a trim collar adapted to be visible or not visible.

BACKGROUND OF THE INVENTION

Recessed light fixtures are usually provided with trim collars which surround the outer edge of the recessed light housing to hide any imperfections about the hole formed in the sheeting material into which the recessed light fixture is mounted. If the recessed light fixture is to be flush mounted within the hole, then it is preferable to mount a plaster collar assembly secured about the open end of the light fixture to which is attach a plaster ring for securement against the outer surface of the sheeting material. An example of such a plaster ring assembly is disclosed and illustrated in U.S. Pat. No. 7,827,737. After installation, plaster is applied over the ring and the sheeting material about the hole to form a flush mounting appearance whereby light exits a hole in the sheeting material with no visible collar about the hole. Such flush mounting usually requires skilled trade people such as a plasterer/painter and can become costly when there are several recessed light fixture installed.

Recessed light fixtures are also produced for different uses. For example, a recess light fixture may contain a plaster trim collar for use in downlighting wherein no collar is visible on the sheet material surface into which the light fixture is mounted, as described above. Recessed light fixtures are produced of different sizes and having different decorative trim collars. It would be advantageous to provide a recessed light fixture assembly wherein the consumer would have the choice of mounting the light fixture within hole formed in a sheet material surface and wherein the consumer person would have the option of mounting the fixture with or without a trim collar being visible and with the same light module, as opposed to having to purchase two complete light fixtures, one with a visible trim collar and the other with a plaster collar to be concealed.

SUMMARY OF THE INVENTION

It is a feature of the present invention to provide a recessed light fixture assembly having a light source support module and one or more open-ended light constraining tubular members removably securable to the light source support module and wherein the light constraining cylinders have different trim collars wherein the recessed light fixture assembly can be mounted with a visible trim collar or a concealed trim collar.

Another feature of the present invention is to provide a recessed light fixture assembly comprised of a single light source support module to which is removably securable two or more light constraining tubular members each of which contains a different type of trim collar, one with a plaster collar wherein the collar can be concealed in plaster, and the other with a visible trim collar.

A further feature of the present invention is to provide a recessed light fixture assembly comprised of a small light source module to which is detachably and immovably secured a selected one of two or more light constraining tubular members each having a different type of trim collar and wherein the tubular members are detachably secured by frictional rotational coupling at an inner end portion of the fixture and substantially concealed from the open end of the cylinders.

Another feature of the present invention is to provide a recessed light fixture assembly having a light source support module and two or more open-ended light constraining tubular members removably securable to the light source support module and wherein the light constraining tubular members have different trim collars wherein the recessed light fixture assembly can be mounted with a visible trim collar or a concealed trim collar and wherein the entire recessed light fixture assembly when fitted with a visible trim collar can be easily removed from its installation for repair or for replacement or modification with a different light constraining tubular member without the use of skilled trades people.

Another feature of the present invention is to provide the consumer with the ability of installing one or more recessed light fixtures by the use of a recessed light fixture assembly comprised of simple elements which are pre-attached to permit the consumer to install the recessed light fixture with a visible trim collar or with an alternative minimalistic slush surface mounted look without having to hire skilled trade people, such as an electrician or plasterer/painter.

According to the above features, from a broad aspect, the present invention provides a recessed light fixture assembly for securement in a hole formed in a sheet material. The light fixture assembly comprises a light source support module having a circumferential wall portion. The light source support module has electrical connection means for securement of the light source to a power source for energising the light source. Two or more open-ended light constraining tubular members, each having a rear end portion provided with securement means for immovable connection to the light source support module for interconnecting a selected one of the open-ended light constraining tubular members, to the light source support module. A first of the two or more open-ended light constraining tubular members has a trim collar extending in a transverse plane about an outer end thereof. A further one of the open-ended light constraining tubular members has a plaster collar extending in a transverse plane spaced a predetermined distance about an outer end thereof. Engageable retention means is secured to the light source support module for retention of the recessed light fixture, with the selected one of the first and second open-ended light constraining tubular member secured thereto, in the hole formed in the sheet material with the collar held firmly against an outer surface of the sheet material about the hole.

BRIEF DESCRIPTION OF THE DRAWINGS

A preferred embodiment of the present invention will now be described with reference to the accompanying drawings in which.

DETAIL DESCRIPTION OF THE INVENTION

Figure 1:
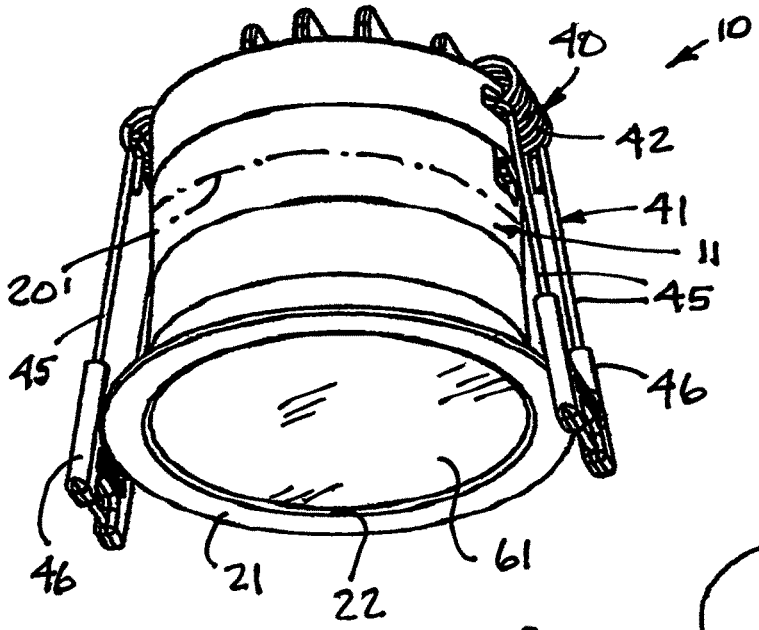
FIG. 1 is a perspective view of the recessed light fixture assembly of the present invention comprised of the light source support module to which is detachably secured one of the two or more light constraining tubular members, herein the light constraining tubular member having a visible trim collar when installed in sheeting material.

A preferred embodiment of the present invention will now be described with reference to the accompanying drawings wherein there is illustrated in FIG. 1 the recessed light fixture assembly 10 of the present invention in one of its optional assembled forms. With further reference to FIGS. 2 to 7, the recessed light fixture assembly 10 is comprised of a light source support module 11 having a circumferential wall portion 12, herein of a cylindrical form. The circumferential wall portion 12 has a lower recessed circumferential wall portion 12' for receiving a connection portion 16' of a light constraining tubular member 16 in frictional sliding fit therein. Electrical connection means, in the form of a female electrical connector 13 is mounted on the rear wall 14 of the light source support module 11. Other electrical type connection means can be provided dependent on the type of light source 15 mounted in the light source support module 11. FIG. 3 illustrates the light source 15 as being an LED light source, but such light source may be in the form of a halogen or incandescent light. A reflector 15' may be mounted behind the light source 15, as shown in FIG. 3

Figure 5:
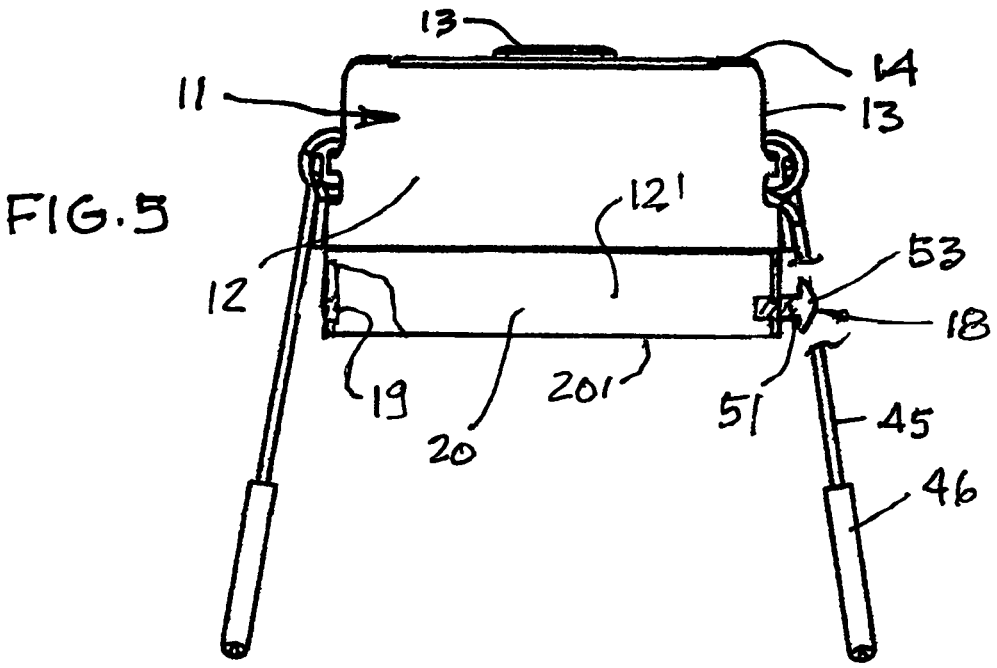
FIG. 5 is a side view of the light source support module partly fragmented.
Figure 6:
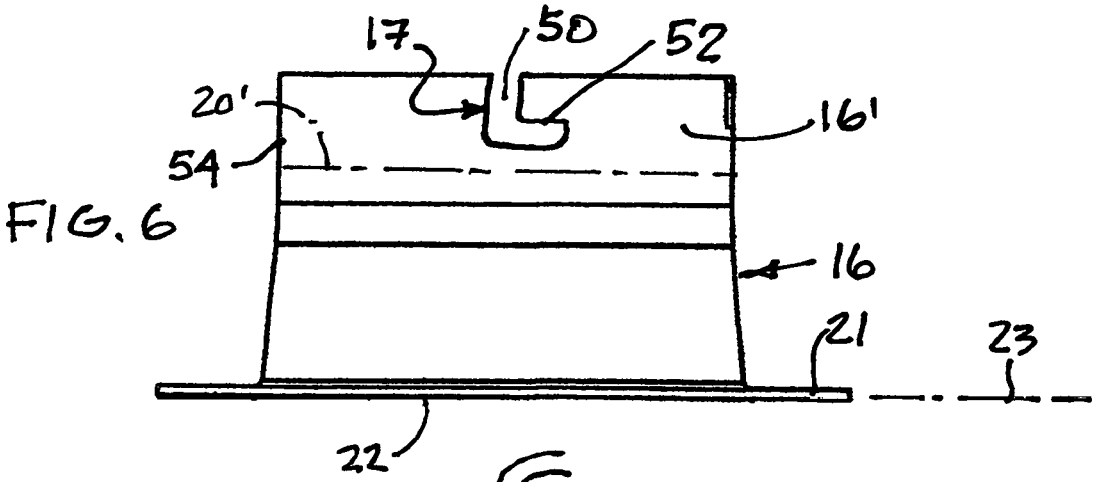
FIG. 6 is a side view of a light constraining tubular member showing the connecting slot which permits removable securement of the light constraining tubular member to the light source support module with the fastener screws, as shown in FIG. 5, engageable in their respective connecting slots.

The recessed light fixture assembly 10 is comprised of two or more light constraining tubular members, a first, as shown in FIG. 6, and comprised of a light restraining tubular member 16 of circular cylindrical shape and having an inner end portion 16' provided with securement means in the form of a connecting slot 17 forming a female connector and which is configured and adapted for attachment to a male screw connector 18 threadedly engaged in a hole 19 formed at a predetermined location in a recessed cylindrical connecting wall portion 20 of the light source support module 11, as shown in FIG. 5. Other type of securement means is contemplated for this interconnection. There are two of said connecting slots 17, each provided on opposed diagonal sides of the inner end portion 16' of the light constraining tubular member 16. There is also two of the male screw connectors 18 provided on opposed diagonal sides of the recessed cylindrical connecting wall portion 20 of the light source support module 11.

Figure 9:
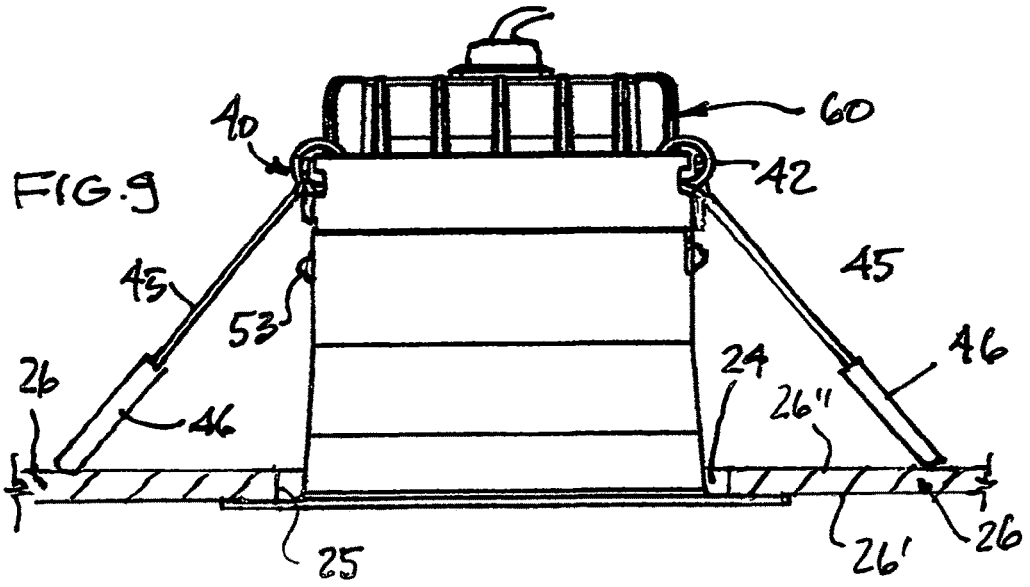
FIG. 9 is a side view illustrating the recessed light assembly of FIG. 1 mounted in a hole formed in a sheet material and wherein the surrounding area of the hole is concealed by the trim collar.

The first light constraining cylinder 16 of the assembly is further provided with a trim collar 21 extending in a transverse plane and flush about an outer end 22 of the cylinder 16. The trim collar 21 is in the form of a flat transverse flange extending a predetermined distance in the transverse plane 23 sufficient to cover any openings 24 about a hole 25 formed in sheet material 26, such as gypsum board material of a wall or ceiling structure, as illustrated in FIG. 9.

Figure 2:
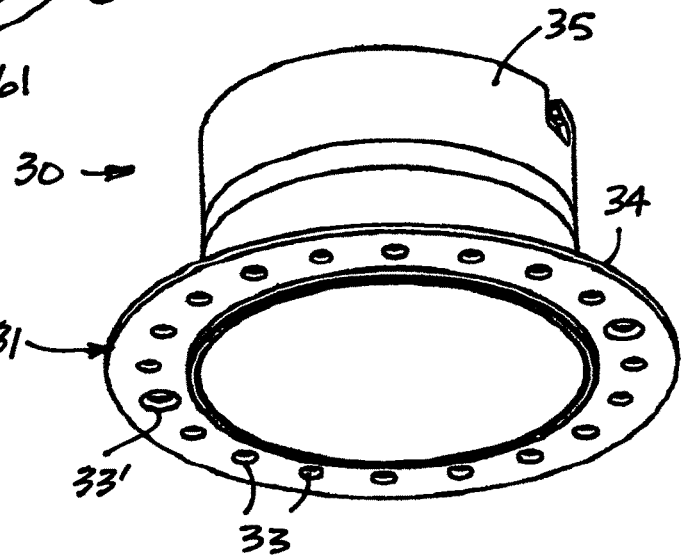
FIG. 2 is a perspective view of a light constraining tubular member having a plaster collar secured thereto and adapted to be concealed by plaster material applied thereto.
Figure 3:
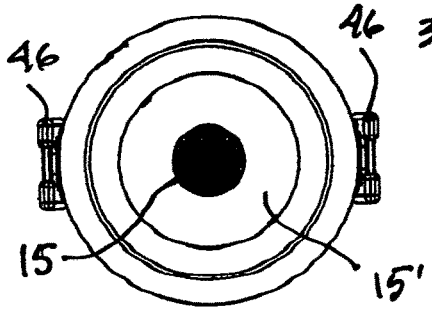
FIG. 3 is a bottom view of FIG. 1.
Figure 4:
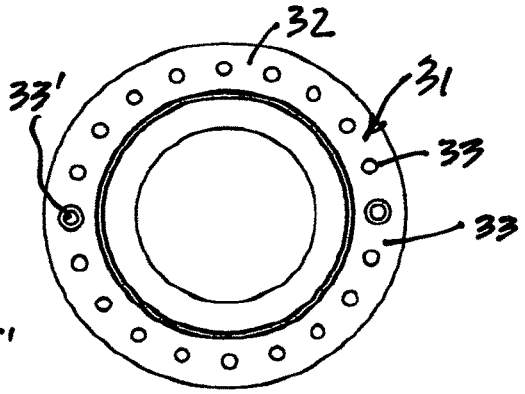
FIG. 4 is a bottom view of FIG. 2.
Figure 8:
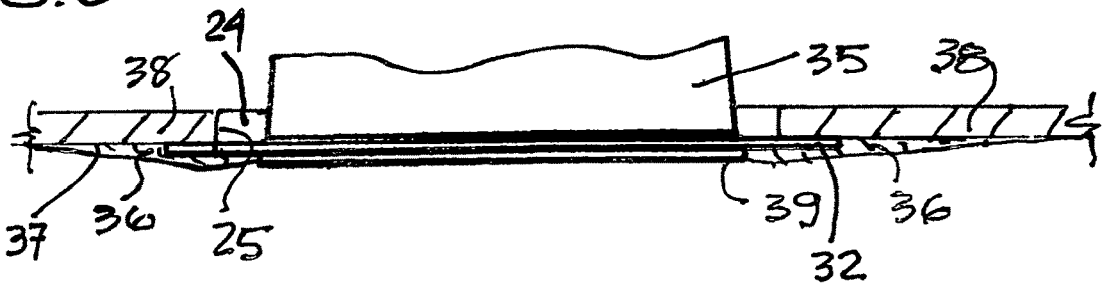
FIG. 8 is a fragmented side view illustrating the concealment of the plaster collar on the outer surface of sheeting material into which the recessed light fixture assembly is mounted.

FIGS. 2 and 8 illustrate the construction and installation of a second open-ended light constraining tubular member 30 and the tubular portion 35 is formed similar to that of the cylinder 16 of the first light constraining cylinder 16 with the exception that the collar is different. The collar 31 of the further light constraining tubular member 30 is a plaster collar 31 formed by a flat transverse circumferential flange 32 having apertures 33 formed there along and spaced a predetermined distance from a circumferential outer end edge 34 of the light constraining tubular member 35 to receive plaster 36 (see FIG. 8) thereover to conceal the circumferential flange 32. The apertures 33 provide for the plaster material to flow through the apertures to be in contact with an outer surface 37 of sheet material 38 to establish a retention connection of the plaster flange 32 with the outer surface 37 of the sheet material 38 while being concealed in the plaster material. Holes 33' are optionally provided to receive screws therein to provide additional securement. As shown in FIG. 8, the plaster material 36 is applied to surround and conceal the plaster collar 31 and terminate flush with the circumferential outer end edge 39 of the light constraining tubular member 35 to form a smooth surface about the outer end edge 39 which when viewed, forms an illuminated hole in the surface material 38.

It is important that the light constraining cylinders be firmly engaged with the light source support module 11 and this is accomplished by the simple securement means of its design, which as described above, is constituted by a pair of configured slot on the cylinder 16 and 30 and two screws 18 which form a pair of female and male interconnection. Of course, other types of connectors are conceivable to accomplish this interconnection. For example, threaded connectors which interlock together. As illustrated in FIGS. 5 and 6, the female connector is the connecting slot 17 is formed in the inner end portion 16' of the side wall of the light constraining cylinder 16 from the rear edge thereof. The connecting slot 17 has a vertical male connector receiving section 50 for receiving the male connector, herein the threaded shaft 52 of the screw 18, and a transverse connecting slot section 52 into which the screw 18 is received and displaced therein to immovably connect the light constraining cylinder with the light source support module. The connection is made by aligning the vertical section 50 of each slot with the threaded shaft 51 of the screws 18 and pushing the light source support module 11 and the light constraining cylinder 16 together until the threaded shaft is at the bottom of the vertical slot section 50 and at which point the light constraining cylinder and the light source support module are rotated in sliding frictional contact to cause the threaded shaft 51 of the screw to enter and slide into the connecting slot section 52 to the end thereof.

The threaded shaft 51 of the screw 18 has a predetermined diameter for close sliding displacement in the connecting slot 52. The screw 18 has an enlarge head 53 which forms a circumferential flange projecting outwardly about the threaded shaft 51. When the screw is in position and located in the connecting slot 52, the screw is rotated for threaded engagement in its hole 19, causing the enlarged head 53 to engage and compress the side wall 54 on opposed sides of the slot section 52 against the cylindrical connecting wall portion 20 of the light source support module 11 for immovable connection therewith whereby no disconnection occurs during manipulation of the fixture.

As shown in FIGS. 1, 5, 7 and 9, the light source support module 11 is provided with engageable retention means 40 for immovable retention of the recessed light fixture 10 with the selected one of the first and second open-ended light constraining tubular members 16 or 30 connected thereto, in the hole 25, see FIG. 9, with its collar, 21 or 32 held firmly against the outer surface 26' of the sheet material 26 about said hole 25. The engageable retention means 40 is constituted by a pair of spring retention arms 41 secured at a rear end of the light source support module 11 for retention engagement with a rear surface 26" of the sheet material 26, as shown in FIG. 9, and spaced from opposed sides of the hole 25.

Each of the pair of spring retention arms 41 is formed by a helical wire section forming a torsion coil 42 retained in a slot 43 formed in a flange 44 on opposed diagonal sides of the rear end of the light source support module 11, as shown in FIG. 1, or to the cylindrical wall portion 13 of the light support module 11 as shown in FIG. 5. The torsion coil 42 has opposed straight wire arms 45 spring biased inwards of said light source support module as shown in FIG. 1. The straight wire arms 45 are interconnected at their ends by an abutment pad formation 46 secured across free ends of said opposed straight wire arms 45 for smooth frictional engagement with the rear surface 26" of the sheet material 26, as shown in FIG. 9.

It is pointed out that the installation of the recessed light fixture assembly is very simple and quickly accomplished by simply displacing the spring retention arms 41 from an inward biased position, as shown in FIG. 1, to an outward and upright position for insertion of the wire arms 45 with their abutment pad formations 46 into the hole 25 and releasing the arms 45 while pushing the light constraining cylinder and light source support module into the hole 25 wherein the spring arms 41 will automatically displace downwards by the force of the torsion spring coil 42 placing their abutment pad formation 46 towards the rear surface 26" of the sheet material 26. As the assembly 10 is pushed in the hole, the pad formations slide over the rear surface 26" and apply an inner pulling force on the light assembly. The torsion spring coil 42 has a torsion force of a strength adequate to apply an inward retention force against the rear surface of the sheet material to maintain a retention force on the trim collar 21 or the plaster collar 32 on the outer surface 26' of said sheet material 26 about said hole 25.

Figure 7:
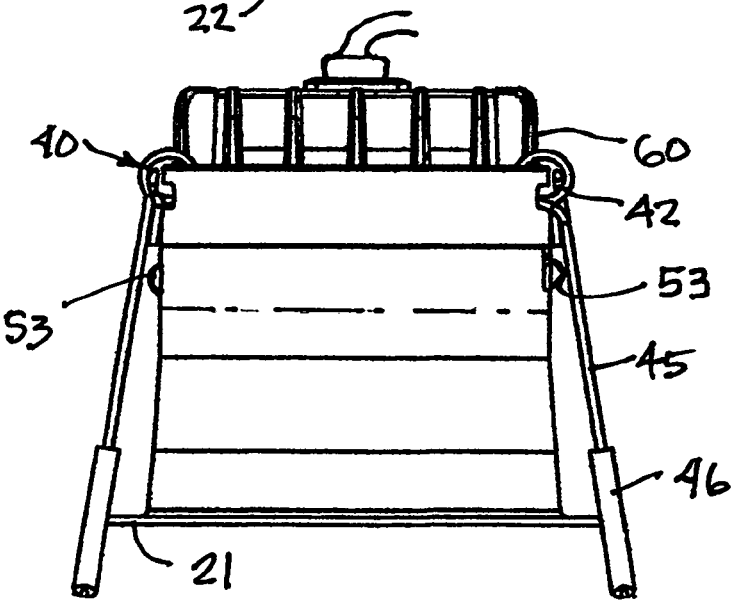
FIG. 7 is a side view of FIG. 1.

Light sources produce heat and to dissipate this heat which is absorbed in the recessed light fixture a heat sink 60 is herein shown mounted in contact with the rear wall 14 of the light source support module 11, as shown in FIGS. 1, 9 and 7. Such heat sinks are well know in the art. Also, as illustrated in FIG. 1, a clear lens 61, such as glass or plastics material, is mounted in the open bottom end of the light fixture and held behind an inner projecting portion of the trim collar, not shown but obvious to a person skilled in the art. It is also pointed out that the side wall of the light constraining tubular members are of predetermined length wherein an inner seam formed by the lower peripheral edge 20' of the light support module is located at a innermost end section inside the cylindrical side wall of the light constraining tubular members not to be immediately visible from the bottom open end of the light constraining tubular member when the light fixture assembly is mounted in a ceiling or wall sheet material with the light source energized. The inner side wall of the light constraining tubular member is therefore substantially free of any joint or partition lines readily visible from the open end of the recessed light fixture and particularly when the light source is energized.

It is important to note the recessed light fixture assembly of the present invention is comprised of only simple elements, namely a single light source support module 11 and two optional tubular portions 16 and 35, each pre-fitted with a different trim collar giving the consumer the option of mounting the recessed light fixture with a visible trim collar or a concealed collar. With the fixed plaster collar, the consumer is given the possibility of applying plaster over the pre-attached plaster collar which is a time consuming task, without having to hire a skilled trade person as such is expensive, particularly if several such recessed light fixtures are installed. Thais is especially facilitated since the plaster collar is pre-attached at a precise distance from the open end of the light fixture permitting the precise amount of plaster to be applied about the open end of the light fixture.

It is within the ambit of the present invention to cover any obvious modifications of the preferred embodiment illustrated and described herein provided such modifications fall within the scope of the appended claims.

The invention claimed is:

1. A recessed light fixture assembly for securement in a hole formed in a sheet material, said light fixture assembly comprising a light source support module having a circumferential wall portion, electrical connection means for securement of said light source to a power source for energising said light source, two or more open-ended light constraining tubular members each having a rear end portion provided with a connector configured for immovable connection to a retention connector provided on said light source support module by rotational coupling for interconnecting a selected one of said two or more open-ended light constraining tubular members to said light source support module, a first of said two or more open-ended light constraining tubular members has a trim collar extending about an outer end thereof, a further of said two or more open-ended light constraining tubular members has a plaster collar extending a predetermined distance about an outer end thereof, and engageable force exerting retention members secured to said light source support module for immovable retention of said recessed light fixture with a selected one of said two or more open-ended light constraining tubular members secured thereto in said hole with said collar held firmly against an outer surface of said sheet material about said hole.

2. The recessed light fixture assembly as claimed in claim 1 wherein said connector configured for immovable connection of said first and further open-ended light constraining tubular members is a female connector adapted for attachment to said retention connector which is a male connector fastener element provided on said cylindrical connecting wall portion of said light source support module.

3. The recessed light fixture assembly as claimed in claim 2 wherein said female connector is a connecting slot formed in an inner end edge of a side wall of said first and further open-ended light constraining tubular members, said connecting slot having a male connector fastener element receiving formation for receiving said male connector fastener element in said connecting slot and a male connector fastener element engaging section into which said male connector is received and engaged to immovably connect said first and further open-ended light constraining tubular members to said light source support module.

4. The recessed light fixture assembly as claimed in claim 3 wherein said connecting slot has an open vertical end section formed in said inner end edge to receive said male connector fastener element therein, said male connector engaging section of said connecting slot extending transverse to said vertical end section and spaced a predetermined distance from said rear edge of said first and further open-ended light constraining tubular members to receive said male connector fastener element therein by rotating said first and further open-ended light constraining tubular members to position said male connector fastener element at an engaging position in said engaging section of said connecting slot.

5. The recessed light fixture assembly as claimed in claim 4 wherein said male connector fastener element is a screw connector having a threaded shaft of predetermined length immovably connected in a hole formed at a predetermined location in said cylindrical wall portion of said light source support module, said threaded shaft of said screw connector having a predetermined diameter for close sliding displacement in said connecting slot.

6. The recessed light fixture assembly as claimed in claim 5 wherein said screw connector has an enlarge head forming a circumferential flange projecting outwardly about said threaded shaft wherein when said screw connector is rotated for threaded engagement said enlarged head will engage and compress said side wall of said light constraining tubular member on opposed sides of said male connecting section of said connecting slot against said side wall of said light source support module for immovable connection therewith, and wherein said trim collar of said first open-ended light constraining tubular members and said plaster collar of said further open-ended light constraining tubular member provides for the recessed light fixture assembly to be mounted with a visible trim collar or no visible trim collar.

7. The recessed light fixture assembly as claimed in claim 5 wherein there are two of said screw connectors each of which is immovably connected to a diagonal side of said cylindrical wall portion of said light source support module and two of said connecting slots formed on opposed diagonal sides of said side wall of said first and further open-ended light constraining tubular members.

8. The recessed light fixture assembly as claimed in claim 1 wherein said force exerting engageable retention members are is constituted by a pair of spring retention arms secured at a rear end of said light source support module for retention engagement with a rear surface of said sheet material on opposed sides of said hole.

9. The recessed light fixture assembly as claimed in claim 8 wherein each of said pair of spring retention arms are formed by opposed wire ends of a helical torsion coil retained in a slot formed in a flange on opposed diagonal sides of said rear end of said light source support module, said helical torsion coil maintaining said spring arms biased inwards of said light source support module, and an abutment pad formation secured across free ends of said opposed straight wire arms for smooth frictional engagement with said rear surface of said sheet material.

10. The recessed light fixture assembly as claimed in claim 9 wherein said straight wire arms are displaceable from an inward biased position to an outward and upright position for insertion of said light constraining tubular member and light source support module into said hole, said helical torsion coil having a torsion force of a strength adequate to apply an inward retention force against said rear surface of said sheet material to maintain a retention force on said trim collar or said plaster collar on an outer surface of said sheet material about said hole.

11. The recessed light fixture assembly as claimed in claim 1 wherein said light source is one of an LED light source, an halogen light source and an incandescent light source.

12. The recessed light fixture assembly as claimed in claim 11 wherein a heat sink is connected to a rear wall of said light source support module to dissipate heat from said module and generated by said light source.

13. The recessed light fixture assembly as claimed in claim 1 wherein said trim collar of said first open-ended light constraining cylinder is a flat transverse circumferential flange extending in said transverse plane about said outer end of said first open-ended light constraining tubular member.

14. The recessed light fixture assembly as claimed in claim 1 wherein said plaster collar of said further open-ended light constraining tubular member is a flat transverse concealable circumferential flange having apertures formed there along and spaced a predetermined distance from one another to receive plaster over said concealable circumferential flange and therein for contact with an outer surface of said sheet material through said apertures to establish a connection of said flange with said outer surface of said sheet material, said plaster being applied to surround and cover said concealable circumferential flange and terminate flush with said circumferential outer end edge of said light constraining cylinder to form a smooth surface about said outer end edge and with an outer surface of said sheet material.

15. The recessed light fixture assembly as claimed in claim 1 wherein said circumferential wall portion of said light source support module has a lower recessed circumferential wall portion for receiving an inner end portion of said first or further open-ended light constraining tubular member in frictional fit therein, said recessed circumferential wall portion having a lower peripheral edge located at an innermost end section inside said first and further open-ended light constraining tubular member wherein an inner side wall of said first and further light constraining tubular member is substantially free of any joint or partition lines readily visible from an open end of said recessed light fixture.

16. The recessed light fixture assembly as claimed in claim 1 wherein said light constraining tubular member is configured to produce a directional light beam, said recess light fixture being a spotlight fixture.

17. The recessed light fixture assembly as claimed in claim 1 wherein said sheet material is a gypsum board material of a ceiling or wall structure.

* * * * *